US011035114B2

(12) United States Patent
Mori et al.

(10) Patent No.: US 11,035,114 B2
(45) Date of Patent: Jun. 15, 2021

(54) PILLAR FIXING METAL FITTING

(71) Applicants: IIDA SANGYO CO., LTD., Musashino (JP); BX KANESHIN CO., LTD., Tokyo (JP)

(72) Inventors: Kazuhiko Mori, Tokyo (JP); Moriyasu Nagayoshi, Tokyo (JP); Naoki Takahashi, Tokyo (JP); Tsuyoshi Makita, Tokyo (JP); Takahiro Yamaguchi, Tokyo (JP)

(73) Assignees: IIDA SANGYO CO., LTD., Tokyo (JP); BX KANESHIN CO., LTD., Tokyo (JP)

( * ) Notice: Subject to any disclaimer, the term of this patent is extended or adjusted under 35 U.S.C. 154(b) by 0 days.

(21) Appl. No.: 16/475,249

(22) PCT Filed: Jan. 10, 2018

(86) PCT No.: PCT/JP2018/000284
§ 371 (c)(1),
(2) Date: Jul. 1, 2019

(87) PCT Pub. No.: WO2019/016979
PCT Pub. Date: Jan. 24, 2019

(65) Prior Publication Data

US 2019/0338506 A1 Nov. 7, 2019

(30) Foreign Application Priority Data

Jul. 20, 2017 (JP) ..... JP2017-140963

(51) Int. Cl.
*E04B 1/10* (2006.01)
*E04B 1/58* (2006.01)
(Continued)

(52) U.S. Cl.
CPC ..... *E04B 1/10* (2013.01); *E04B 1/58* (2013.01); *E04B 1/24* (2013.01); *E04B 1/26* (2013.01);
(Continued)

(58) Field of Classification Search
CPC ..... E04B 1/10; E04B 1/24; E04B 1/26; E04B 1/58; E04B 2001/2415; E04B 2001/2644;
(Continued)

(56) References Cited

U.S. PATENT DOCUMENTS 2,339,220 A * 1/1944 Crowley ..... E04B 1/14 52/282.4
2,574,074 A * 11/1951 Vogel ..... E04B 1/2403 52/377
(Continued)

FOREIGN PATENT DOCUMENTS

CA 2950717 A1 * 6/2017 ..... E04C 3/36
CN 106013443 A 10/2016
(Continued)

OTHER PUBLICATIONS

Feb. 27, 2018 International Search Report issued in International Patent Application No. PCT/JP2018/000284.
(Continued)

*Primary Examiner* — Patrick J Maestri
*Assistant Examiner* — Joseph J. Sadlon
(74) *Attorney, Agent, or Firm* — Oliff PLC

(57) ABSTRACT

The fixing metal fitting including: a joint base in groove shape mainly composing a joint metal; a cover spacer in groove shape capable of supporting the pillar's axial load by covering the joint base, wherein joint base including: a plane section in rectangular shape coinciding with an end surface of the pillar; a pair of groove walls bent vertically in L shape; and a joining plate standing from the plane section and
(Continued)

supported by welded part J contacting at least the pair of groove walls or groove bottom, wherein the cover spacer including: a plane section in rectangular shape for supporting pillar by abutting to the pillar's end surface; a pair of groove walls composed of side edges of plane section respectively bent vertically in L shape; and a slit drilled such that the joining plate will be fitted into slit when the cover spacer is covering the joint base.

13 Claims, 14 Drawing Sheets

(51) Int. Cl.
*E04B 1/24* (2006.01)
*E04B 1/26* (2006.01)
*E04H 9/02* (2006.01)

(52) U.S. Cl.
CPC ..... *E04B 2001/2415* (2013.01); *E04H 9/02* (2013.01)

(58) Field of Classification Search
CPC ..... E04B 2001/2672; E04B 2001/2684; E04H 9/02; E04H 12/2261; E04H 12/2269
USPC ..... 52/264
See application file for complete search history.

(56) References Cited

U.S. PATENT DOCUMENTS 3,665,662 A * 5/1972 Timbrook ..... E04B 1/10 52/210
3,666,298 A * 5/1972 Reilly ..... A47B 47/0008 403/172
3,701,613 A * 10/1972 Turner ..... F16L 3/24 403/387
D254,476 S * 3/1980 Gilb ..... D8/349
4,199,908 A * 4/1980 Teeters ..... E04H 12/2284 248/357
4,231,198 A * 11/1980 Augier ..... E04B 1/21 403/171
D260,964 S * 9/1981 Gilb ..... D8/373
4,365,736 A * 12/1982 Stumm ..... E04B 1/5806 228/121
4,438,726 A * 3/1984 Osthoff ..... A01K 1/0151 119/450
4,673,308 A * 6/1987 Reilly ..... A47F 5/14 403/172
4,698,863 A * 10/1987 Mis ..... A47C 23/043 403/205
4,914,879 A * 4/1990 Goldberg ..... E04B 1/14 52/242
4,924,648 A * 5/1990 Gilb ..... E04B 1/41 52/295
5,207,042 A * 5/1993 Molinar ..... E04B 1/0007 52/293.1
D337,513 S * 7/1993 Soloway ..... D10/106.1
5,229,051 A * 7/1993 Martin ..... B28B 7/266 264/261
5,307,603 A * 5/1994 Chiodo ..... E04B 1/2608 52/297
5,353,560 A * 10/1994 Heydon ..... B26D 3/006 52/241
5,375,384 A * 12/1994 Wolfson ..... E04B 1/0007 52/295
5,575,591 A * 11/1996 Vanderklaauw ..... E01D 2/00 405/230
5,803,782 A * 9/1998 Selton ..... A47B 47/0016 446/125
5,839,249 A * 11/1998 Roberts ..... E04B 1/14 52/745.08
5,862,642 A * 1/1999 Erwin ..... E04H 17/1413 52/834
6,079,152 A * 6/2000 Hou ..... A01G 9/1423 47/17
6,401,423 B1 * 6/2002 Bergeron ..... E04B 2/7453 52/241
6,513,290 B2 * 2/2003 Leek ..... E04B 1/2604 52/295
6,612,087 B2 * 9/2003 diGirolamo ..... E04B 2/767 403/403
7,444,787 B2 * 11/2008 Cutforth ..... E02D 27/16 52/295
7,637,069 B2 * 12/2009 Iri ..... E04B 1/24 52/655.1
7,690,167 B2 * 4/2010 Antonie ..... E04B 1/28 52/481.1
7,761,973 B2 * 7/2010 Toback ..... E04C 3/32 29/525.13
7,793,476 B2 * 9/2010 Sanders ..... E04B 1/41 52/296
8,327,596 B2 * 12/2012 Bratton ..... E04B 1/28 52/481.1
8,341,905 B2 * 1/2013 Macchiaverna ..... E04G 21/185 52/295
8,364,620 B2 * 1/2013 Boardman ..... E04B 1/3483 706/45
8,683,758 B2 * 4/2014 Christopoulos ..... E04B 1/2403 52/167.3
8,959,857 B1 * 2/2015 Lin ..... E04H 12/2261 52/296
9,057,190 B1 * 6/2015 Winter ..... E04B 1/2403
9,097,001 B2 * 8/2015 Espinosa ..... E04B 1/4157
9,115,489 B2 * 8/2015 Bourdon ..... E04B 2/90
9,234,350 B1 * 1/2016 Gilbert ..... E04C 3/36
9,428,902 B1 * 8/2016 LoFranco ..... E04B 1/185
9,677,297 B2 * 6/2017 Warner ..... E04H 12/2269
10,428,553 B2 * 10/2019 Parenti ..... E04H 12/2276
D869,936 S * 12/2019 Smith ..... E04B 1/0007 D8/349
10,704,222 B2 * 7/2020 Grussenmeyer ..... E04C 5/06
10,711,462 B1 * 7/2020 Gilbert ..... E04B 1/2604
10,844,590 B2 * 11/2020 Tanaka ..... B28B 7/266 264/261
10,920,415 B2 * 2/2021 Jones ..... E04B 1/24 52/282.4
2007/0267552 A1 * 11/2007 Meyer ..... E04H 12/2261 248/156
2008/0053020 A1 * 3/2008 Collins ..... E04B 1/24 52/282.4
2013/0180190 A1 * 7/2013 Bovet ..... E04C 1/397 52/220.1
2018/0238042 A1 * 8/2018 Collins ..... E04B 1/2403
2018/0258631 A1 * 9/2018 Pearson ..... E04B 1/2403

FOREIGN PATENT DOCUMENTS

DE 102004024316 A1 * 12/2005 ..... E04B 1/10
JP H11256684 A 9/1999
JP 2002-364069 A 12/2002
JP 2003-155781 A 5/2003
JP 3714902 B2 * 11/2005 ..... E04B 1/10
JP 2006-322275 A 11/2006
JP 2007186954 A 7/2007
JP 2012021303 A * 2/2012 ..... E04C 3/36
JP 2012-184565 A 9/2012
WO WO-8505141 A1 * 11/1985 ..... E04C 3/07

OTHER PUBLICATIONS

Jan. 22, 2021 Office Action issued in Chinese Patent Application No. 201880016288.8.

* cited by examiner

PILLAR FIXING METAL FITTING

BACKGROUND OF THE INVENTION

Field of the Invention

Present invention relates to a pillar fixing metal fitting, more precisely, relates to a pillar fixing metal fitting for fixing a pillar by joining the pillar to a horizontal member such as a foundation or a crosspiece (a beam, a girder). The present application claims priority based on Japanese Patent Application No. 2017-140963 filed in Japan on Jul. 20, 2017, which are incorporated by reference herein.

Description of Related Art

As one of construction method of wooden structure of building structure, a wooden framework construction method is known, which is a construction method simplifying and developing a traditional construction method developed in Japan from long ago. The wooden framework construction method is also called conventional construction method, and it is having a structure to support a building mainly by a framework such as a pillar and a beam, and it is a construction method having an advantage that freedom of designing is relatively high.

Recently, a wooden wall frame construction method is becoming popular with respect to conventional wooden framework construction method. The wooden wall frame construction method is called "Framing" in North America, but in Japan, it is so-called "two-by-four construction method (2×4 construction method)". The wooden wall frame construction method is having a structure to support a building by walls and a floor (surface material) in which structural plywood is nailed to woods assembled in a frame shape, and it is a construction method having an advantage that surface materials half-finished in a factory can be assembled relatively easily by a field work.

In addition, a wooden wall frame construction method having both advantages of 2×4 construction method and conventional wooden framework construction method is also becoming popular, and it is called wooden framework panel construction method (hereinafter, referred to as "I.D.S construction method"). In this I.D.S construction method, it is necessary to self-stand pillar materials only by framework. Therefore, joints are applied at fitting parts of structural materials, and by combining these joints, closely fitted state is formed, and self-standing state was maintained. Without citing any concrete example, a protrusion for joining is provided at pillar side and a hole for joining is provided at horizontal member (foundation, beam, girder or the like) side respectively, and a joining by mutually fitting these protrusion and hole is used.

Recently, a drift-pin construction method is frequently used with influence of administrative guidance for strengthening earthquake resistance with respect to wooden construction house. The drift-pin construction method is a construction method for constructing wooden building by adopting drift-pin joint using metal fitting to parts for fixing a pillar, a beam, a foundation, a horizontal member and else.

At first, in case of conventional construction method, not only when joining a pillar and a beam, but also when joining a beam and a beam, they are fixed by inserted mutually, so a recess and a protrusion exist at either one of them. At these joined parts, even when one is inserted into other, a cross section of originally placed member will only be a part remained after processing, so the joined part will be a main weak spot. Especially, in case of a through pillar, at a joined part where beams are inserted from four directions, a member of originally placed pillar will be lost largely for holes for joining, so only a central part of the pillar remains barely. Therefore, it is indicated as first cause for a collapse of a house by earthquake that the through pillar, which was overestimated as thick and strong, will be broken by lateral vibration.

As second cause for a collapse of a house by earthquake, there is "drop out or fall out of joined part" by earthquake vibration. In this case, even if it is a wooden house reinforced by diagonal brace, if the diagonal brace is dropped out, it is known that it will collapse as if blocks shake and fall down. On the other hand, a purpose of a drift-pin construction method is to reduce lost cross section of a pillar and a beam, and metallic material and drift pin are configured to prevent "drop out or fall out of joined part" when receiving stress by earthquake vibration. Concretely, the joined part of the pillar and else is fixed rigidly by the metallic material with a structure that the metallic material is inserted into a groove dug at a wood to create a joint and that the drift pin is inserted into the joint.

In addition, even by using this drift-pin construction method, there is a case that yield strength for earthquake vibration will be decreased significantly. As first cause for decreasing earthquake-resistant strength in the drift-pin construction method, there is a case that a technique of worker executing the work is extremely low. In addition, as second cause for decreasing earthquake-resistant strength in the drift-pin construction method, there is a case that a part of a wood fixed by metallic material will be broken by drying shrinkage and else. Therefore, in the drift-pin construction method, metallic material is combined with a wood, and at the joined part fixed by the drift pin, it is possible to obtain an effect to fix the joined part of the pillar and else rigidly by the metallic material, but relatively high accuracy is required for processing a wood. In other words, the drift-pin construction method is a construction method which requires significant consideration for producing and working woods.

In addition, in Patent Literature 1, "Joining device for column and horizontal member" achieving accuracy of positioning, and also, improving endurance is disclosed. This is the invention to fix a joined part of a pillar rigidly by preventing drop out of the pillar from a horizontal member by a pillar fixing metal fitting with characteristic structure. As a result, it secured a rigid structure which can endure strong wind such as typhoon. In addition, as typical crosspiece (hereinafter, also called as "horizontal member"), there are a beam, a girder, a girth, a foundation and else.

Patent Literature 1: JP 2003-155781 A

SUMMARY OF THE INVENTION

However, "Joining device for column and horizontal member" of Patent Literature 1 is assuming to join one pillar such as solid wood to the horizontal member, so it is not optimized for applying to 2×4 construction method, and there was a room for improvement. In addition, there was also a room for improvement for achieving an idea to correspond to a request for securing earthquake resistant strength, a request for simplifying assembly, and a social condition that it is difficult to secure skilled workers.

The present invention has been invented considering the above problem, and the purpose of the present invention is to provide a fixing metal fitting which can be assembled easily and having high earthquake-resistant and wind-resistant strength and high misalignment accuracy, and which can be optimized not only for I.D.S construction method but also for 2×4 construction method by making joint fitting using joint by manual operation of skilled worker unnecessary.

The present invention is invented for achieving such purpose, and the invention described in claim 1 is a pillar fixing metal fitting (100, 110) for joining a pillar (300) to a horizontal part (180, 200, 280), comprising: a joint base (30, 31) in groove shape mainly composing a joint metal; a cover spacer (80, 90) in groove shape capable of supporting axial load of the pillar (300) by covering an open surface of the joint base (30, 31), wherein the joint base (30, 31) comprising: a plane section (10, 11) in rectangular shape in which bolt holes (18, 19) are drilled and a shape of which coincides with an end surface (301) of the pillar (300); a pair of groove walls (14, 15) composed of side edges of the plane section (10, 11) respectively bent vertically in L shape; and a joining plate (20, 21) standing at a height (H) surpassing the groove walls (14, 15) from the plane section (10, 11) and supported by welded part (J) contacting at least the pair of the groove walls (14, 15) or a groove bottom, wherein the cover spacer (80, 90) comprising: a plane section (81, 91) in rectangular shape for supporting the pillar (300) by abutting to the end surface (301) of the pillar (300); a pair of groove walls (82, 92) composed of side edges of the plane section (81, 91) respectively bent vertically in L shape; and a slit (83, 93) drilled such that the joining plate (20, 21) will be fitted into the slit (83, 93) when the cover spacer 80 is covering the joint base (30, 31), wherein in a state assembled as the joint metal, fastening bolts (260, 160) penetrated through or embedded in a horizontal member (200) composing the horizontal part (180, 200, 280) are penetrated through the bolt holes (18, 19), and the plane section (10, 11) of the joint base (30, 31) is fastened to the horizontal member (200) by nuts (60), further, the joining plate (20, 21) is penetrated through the slit (83, 93), and also, tips (161) of the fastening bolts (260, 160) and the nuts (60) screwed to the fastening bolts (260, 160) are housed in a box-shaped space (84, 94) surrounded by the joint base (30, 31) and the cover spacer (80, 90), the end surface (301) of the pillar (300) abuts the plane section (81, 91) of the cover spacer (80, 90), and also, the pillar (300) and the joining plate (20,21) fitted into a groove hole (308, 309) drilled at the pillar (300) are drift-pin joined by a plurality of drift pins (99).

In addition, the invention described in claim 2 is the pillar fixing metal fitting (100, 110) according to claim 1, wherein the pillar (300) is composed of dimension lumbers (310, 320, 330) of wooden wall frame construction method (2×4 construction method) superposed plurally in thickness direction (X).

In addition, the invention described in claim 3 is the pillar fixing metal fitting (100) according to claim 2, wherein fitting holes (1 to 3) for the drift pins (99) are drilled at each vertex of triangle drawable on plate surface of the joining plate (20), and penetrating through wide surfaces (311, 321, 331) of the dimension lumbers (310, 320, 330) and the joining plate (20) vertically.

In addition, the invention described in claim 4 is the pillar fixing metal fitting (110) according to claim 2, wherein fitting holes (4 to 6) for the drift pins (99) are drilled at equal intervals on a straight line parallel to the plane section (11) on plate surface of the joining plate (21), and penetrating through thickness surfaces (312, 322, 332) of the dimension lumbers (310, 320, 330) and the joining plate (21) vertically.

In addition, the invention described in claim 5 is the pillar fixing metal fitting (100, 110) according to any of claims 1 to 4, wherein the horizontal member (200) is composed of a foundation concrete (150) or a foundation (180, 280) mounted on the foundation concrete (150), and the fastening bolts (160) are composed of anchor bolts (160) embedded in the foundation concrete (150).

In addition, the invention described in claim 6 is the pillar fixing metal fitting (100, 110) according to any of claims 1 to 5, wherein the plane section (10, 11) of the joint base (30, 31) arranged respectively on both upper and lower surfaces (281, 282) of a crosspiece (280), which is the horizontal member (200), is fastened by the fastening bolts (160) penetrating through the crosspiece (280) and the nuts screwed to the fastening bolts (160), and also, each of the joining plate (20, 21) of each of the joint base (30, 31) is drift-pin joined to respective pillar (300 or 360).

According to the present invention, it is possible to provide a fixing metal fitting which can be assembled easily and having high earthquake-resistant and wind-resistant strength and high misalignment accuracy, and which can be optimized not only for I.D.S construction method but also for 2×4 construction method by making joint fitting using joint by manual operation of skilled worker unnecessary.

BRIEF DESCRIPTION OF THE DRAWINGS

FIG. 5 is five surface drawings illustrating the joint base of FIG. 3 in a method of projection.

FIG. 6 is six surface drawings illustrating the cover spacer of FIG. 4 in a method of projection.

FIG. 12 is five surface drawings illustrating the joint base of FIG. 10 in a method of projection.

FIG. 13 is six surface drawings illustrating the cover spacer of FIG. 11 in a method of projection.

DETAILED DESCRIPTION OF THE INVENTION

In below, explaining about embodiments of the present invention by referring to drawings. In addition, throughout entire drawings, repeated explanation is omitted by giving identical reference number to members having identical effect. This metal fitting is a pillar fixing metal fitting for joining a pillar to a horizontal member, wherein the pillar fixing metal fitting is applied to a drift-pin construction method. Hereinafter, explaining about first embodiment of the present invention by referring to FIGS. 1 to 7.

First Embodiment

Figure 1:
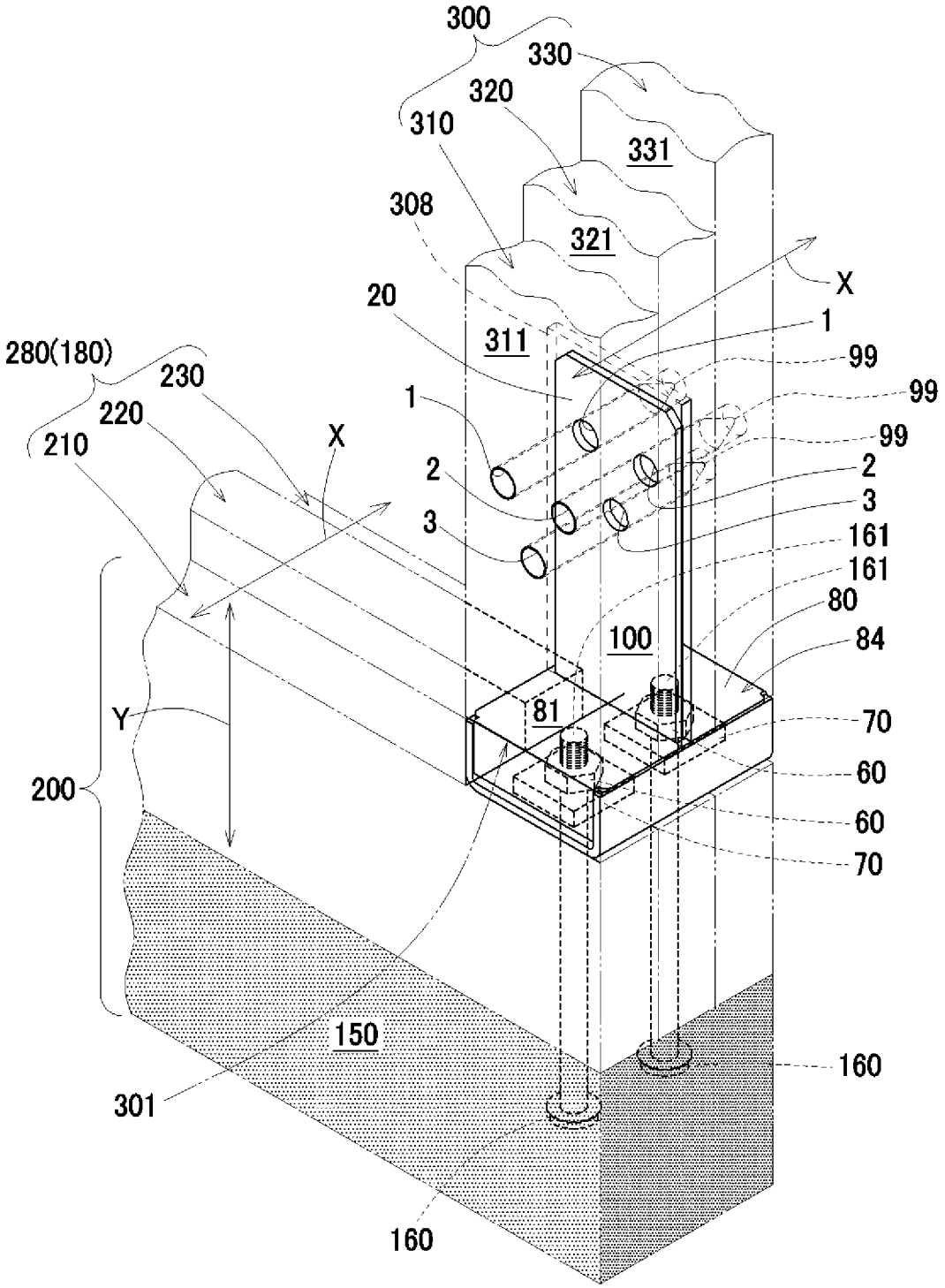
FIG. 1 is a perspective view illustrating used state of a pillar fixing metal fitting (hereinafter, also referred to as "this metal fitting") relating to first embodiment of the present invention.

FIG. 1 is a perspective view illustrating used state of a pillar fixing metal fitting (hereinafter, also referred to as "this metal fitting") relating to first embodiment of the present invention. As illustrated in FIG. 1, this metal fitting 100 is a joint metal fitting for drift-pin joining a pillar to a horizontal member in a construction method for constructing wooden building by using drift-pin construction method. Further, this metal fitting 100 is more preferably specialized for wooden wall frame construction method, i.e. two-by-four construction method (2×4 construction method), and for I.D.S construction method, i.e. wooden framework panel construction method.

This metal fitting 100 is composed of mainly two components at the time of distribution and sales, i.e. before used for construction. Two main components are a joint base 30 (FIG. 3) and a cover spacer 80. About other components such as drift pins 99 for fixing, fastening bolts 160, nuts 60 fitting with the fastening bolts 160, and washers 70, it will be explained briefly later.

A horizontal member 200 is composed of a foundation concrete 150, or a foundation 180 mounted on the foundation concrete 150. Also, anchor bolts 160 embedded in the foundation concrete 150 function as the fastening bolts 160 for fixing this metal fitting 100 to the horizontal member. In addition, in here, a wood such as a beam not mounted on the foundation concrete 150 is also included in the horizontal member 200. Also, a crosspiece 280 secures a volume and a strength corresponding to solid wood by superposing three dimension lumbers 210, 220, 230 of 2×4 construction method in thickness direction X. Here, as typical dimension lumber in 2×4 construction method, a dimension lumber having a section of 38 mm*89 mm is illustrated by example, but it is not limited to this dimension lumber.

Also, in the foundation concrete 150, a pair of anchor bolts 160 are arranged to be protruded by embedding anchor portion. A spacing between these pair of anchor bolts 160 is preferable to be such that these pair of anchor bolts 160 penetrate only both outer side dimension lumbers 210, 230 of three dimension lumbers 210, 220, 230 superposed in thickness direction X, respectively penetrating the dimension lumbers 210, 230 in width direction Y at center of thickness direction X.

In addition, recently, a construction method called foundation direct coupling (hereinafter, also referred to as "foundation direct coupling construction method"), in which a pillar 300 is directly stood on a foundation concrete 150 embedded with an anchor bolt 160 without the foundation 180, is also known. The foundation concrete 150 in this foundation direct coupling construction method is also included in the "horizontal part" of the present invention. In other words, the "horizontal part" of the present invention means a matter including the above-mentioned foundation 180, horizontal member 200, crosspiece 280, and also, foundation concrete 150 in foundation direct coupling construction method. Therefore, this metal fitting can be applied to three horizontal parts, i.e. foundation concrete 150 only in foundation direct coupling, horizontal member (foundation concrete 150+foundation 180) 200, and crosspiece 280 only.

Also, as well as the crosspiece 280, the pillar 300 also secures a volume and a strength corresponding to solid wood by superposing three dimension lumbers 310, 320, 330 of 2×4 construction method in thickness direction X. Also, as typical dimension lumber in 2×4 construction method, a dimension lumber having a section of 38 mm*89 mm is illustrated by example, but it is not limited to this dimension lumber.

In addition, the dimension lumbers 310, 320, 330 forming the pillar 300 and the dimension lumbers 210, 220, 230 forming the crosspiece 280 are illustrated by different reference numbers, but common woods by unified standards are used. As a result, it is having an effect to reduce a burden of material procurement significantly by reducing types of materials. This effect is an advantage of 2×4 construction method and I.D.S construction method, but this metal fitting 100 suitable for these construction methods functions as joint metal for exerting this effect more significantly.

Fitting holes 1 to 3 for the drift pins 99 are composed with hole size and position relation such that they are drilled at each vertex of regular triangle drawable on plate surface of the joining plate 20, and penetrating through wide surfaces 311, 321, 331 of the dimension lumbers 310, 320, 330 and the joining plate 20 vertically. In addition, penetrating holes of the dimension lumbers 310, 320, 330, penetrating holes of the joining plate 20, and respective fitting hole 1 to 3 capable of fitting in each drift pin 99 by penetrating through the dimension lumbers 310, 320, 330 and the joining plate 20 are having identical reference numbers.

As mentioned above, also in wide surfaces 311, 321, 331 of the dimension lumbers 310, 320, 330, the fitting holes 1 to 3 for the drift pins 99 are drilled at each vertex of drawable regular triangle. As such, the fitting holes 1 to 3 are positioned at each vertex of regular triangle, so it is possible to minimize decrease of strength by lightening for an amount of the fitting holes 1 to 3. In addition, about the above regular triangle, it is only an example and it should not be limited to the regular triangle, and it may be other general triangles.

When the fitting holes 1 to 3 are arranged in straight line with respect to each of wide surfaces 311, 321, 331 of the dimension lumbers 310, 320, 330, there is a risk to be a cause for inducing breakage, like perforations for facilitating cutting of stamps, so it is preferable to avoid arranging the fitting holes 1 to 3 in straight line. In addition, a number of the drift pins 99 is not limited to three.

Figure 2:
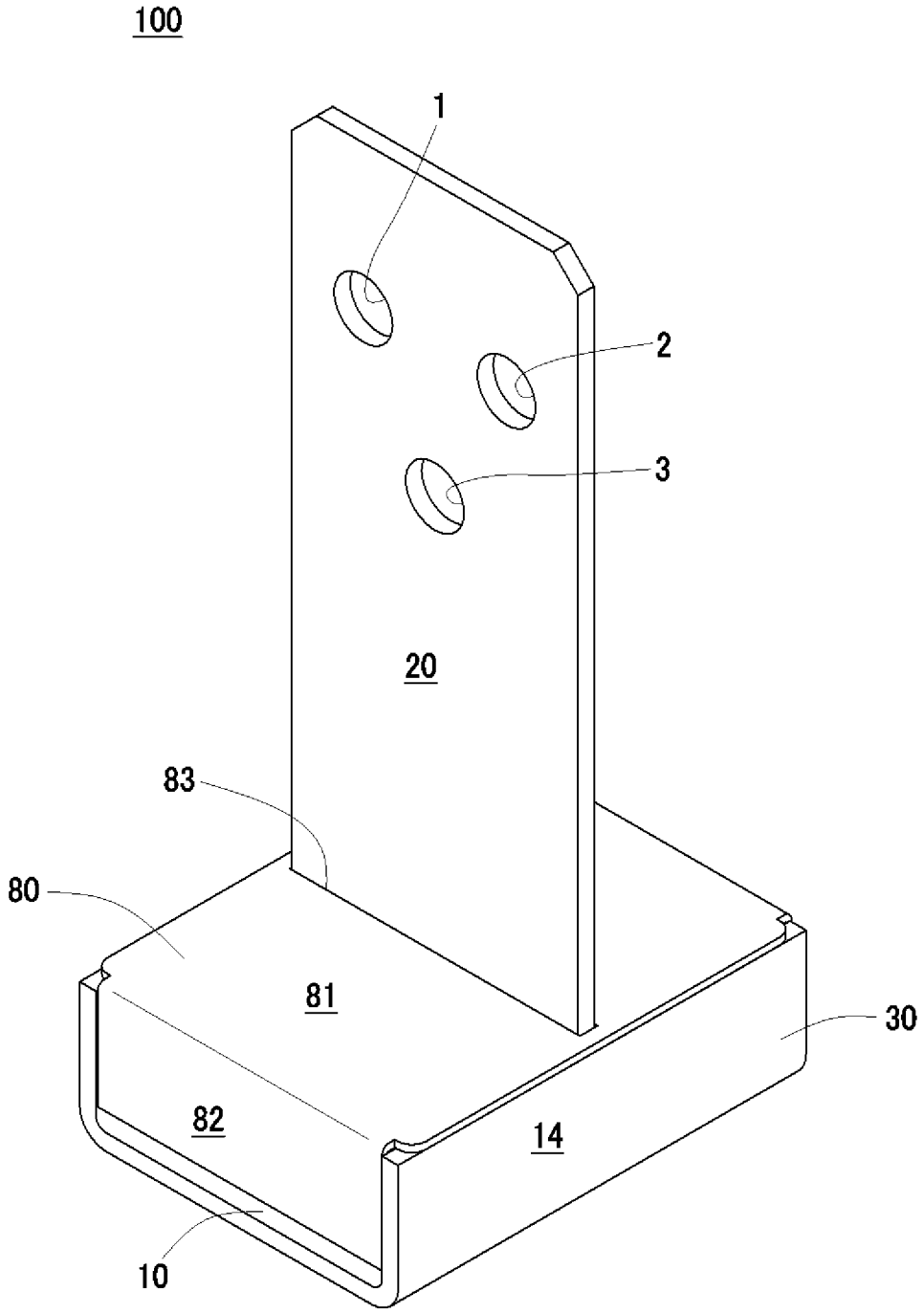
FIG. 2 is a perspective view illustrating entirety of this metal fitting by extracting this metal fitting from FIG. 1.
Figure 3:
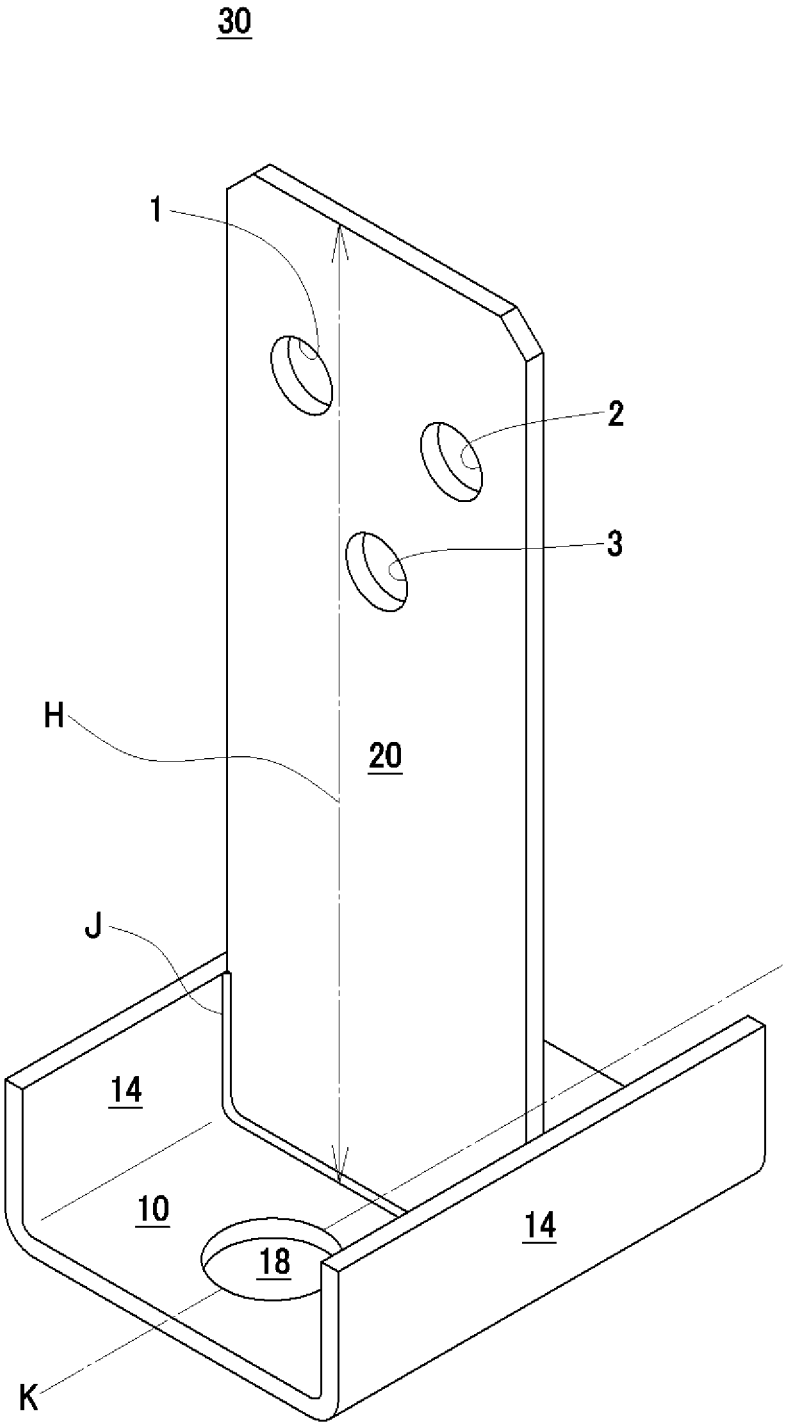
FIG. 3 is a perspective view illustrating a joint base mainly composing this metal fitting illustrated in FIGS. 1 and 2.
Figure 4:
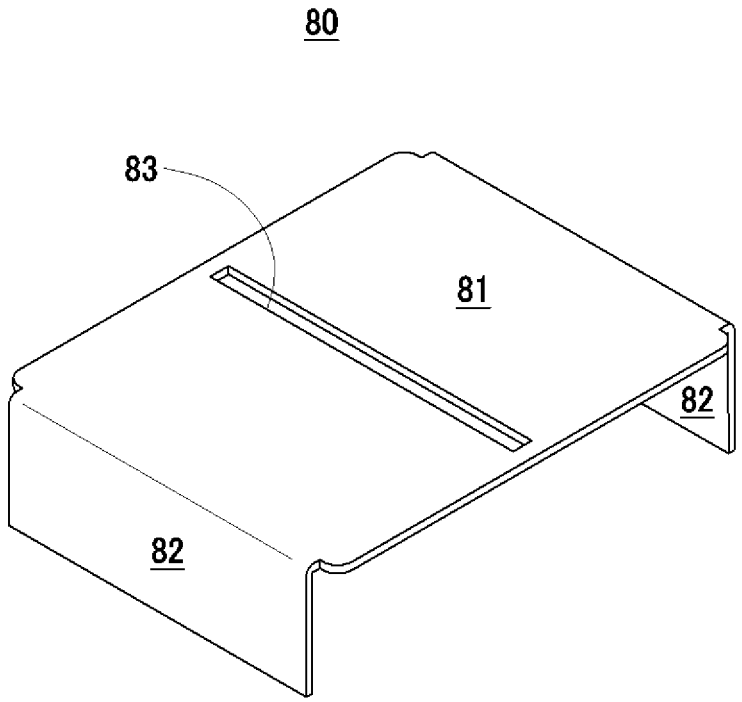
FIG. 4 is a perspective view illustrating a cover spacer in groove shape for covering the joint base illustrated in FIG. 3.

FIG. 2 is a perspective view illustrating entirety of this metal fitting by extracting this metal fitting from FIG. 1. FIG. 3 is a perspective view illustrating a joint base mainly composing this metal fitting illustrated in FIGS. 1 and 2. FIG. 4 is a perspective view illustrating a cover spacer in groove shape for covering the joint base illustrated in FIG. 3. This metal fitting 100 illustrated in FIGS. 1 to 3 is used as joint metal by combining a cover spacer 80 and a joint base 30 such that the cover spacer 80 covers an open surface of the joint base 30 in groove shape, after fastening the joint base 30 to the horizontal member 200 by bolt when constructing wooden building.

This metal fitting 100 is capable of fastening the joint base 30 to the horizontal member 200 by bolt, covering the joint base 30 with the cover spacer 80, arranging and abutting the end surface 301 of the pillar 300 on the cover spacer 80, and fixing the pillar 300 by supporting axial load of the pillar 300. This cover spacer 80 is a member also formed in groove shape similar to the joint base 30. Hereinafter, explaining in more detail about the joint base 30 and the cover spacer 80 respectively. In addition, about to connect the pillar 300 rigidly to the horizontal member 200 by self-standing the pillar 300 on the horizontal member 200, it will be described later.

The joint base 30 is formed by bending sheet metal to groove shape and cutting length of the groove to a predetermined length to form a main part and welding other part to the main part, and configured to comprise a plane section 10, a pair of groove walls 14, and a joining plate 20. The plane section 10 corresponds to a groove bottom of the groove shape bended to groove shape, and it is in rectangular shape coinciding with a shape of the end surface 301 of the pillar 300. About end surface of the pillar, solid wood is often in square shape, but dimension lumbers 310, 320, 330 of 2×4 construction method is having a thickness of 38 mm, and a size of the end surface 301 of the pillar 300 composed by superposing the dimension lumbers in three layers is 114 mm*89 mm and in rectangular shape. However, this is only an example, and according to application of this metal fitting 100, the plane section 10 may be formed in square shape. In addition, a number of laminated layers of the dimension lumbers is also not limited to three layers.

In this plane section 10, two bolt holes 18, 19 are drilled in predetermined spacing at predetermined positions along center line K in the groove shape. The pair of groove walls 14 are formed by respectively bending edges parallel to the center line K vertically with respect to the plane section 10 in L shape. The joining plate 20 is a separate part from the main part in groove shape, and arranged to stand between two bolt holes 18, 19 in the plane section 10 at a height H surpassing the groove walls 14. The joining plate 20 is rigidly welded to the pair of groove walls 14 and the groove bottom positioned between the pair of groove walls 14 and supported at three sides continuously at welded part J contacting the pair of groove walls 14 and the groove bottom respectively. When there is allowance in strength, the welded part J may be configured to support at three sides discontinuously. In addition, configuration to be supported at three sides at the welded part J is only an example, and it may be supported at two sides or one side.

In addition, the feature that there is two bolt holes 18, 19 in the plane section 10 is only an example, and for example, a number of bolt holes may be one to four. In any case, it is configured such that the bolt hole drilled at the plane section 10 does not interfere with the joining plate 20. Concretely, when there are two bolt holes 18, 19, the joining plate 20 is arranged to stand at a position not interfering with a tip of respective bolt protruding from each of bolt hole and a nut fastened to a tip of respective bolt, in other words, the joining plate 20 is arranged to stand between bolts and nuts fastened to the bolts.

Similarly, when there are four bolt holes (not illustrated), bolt holes will be drilled at four corners of the plane section 10, but as well as the case with two bolt holes, the joining plate 20 is arranged to stand at a position not interfering with a tip of respective bolt protruding from each of bolt hole and a nut fastened to a tip of respective bolt, in other words, the joining plate 20 is arranged to stand between bolts and nuts fastened to the bolts. Conversely, when there is one bolt hole (not illustrated), bolt hole will be drilled at a center of the plane section 10, and the joining plate 20 in a shape to avoid interference with a bolt and a nut protruding from the bolt hole is arranged to stand by straddling a tip of the bolt and the nut fastened to the bolt. In other words, a recess is provided at corresponding position of the joining plate (unillustrated) where interference with the tip of the bolt and the nut is expected.

The cover spacer 80 is configured to comprise a plane section 81, a pair of groove walls 82, and a slit 83. The plane section 81 is in rectangular shape for supporting the pillar 300 by abutting to the end surface 301 of the pillar 300, and about the size of the plane section 81, it is similar as the plane section 10 of the joint base 30. The pair of groove walls 82 are formed by respectively bending edges of the plane section 81 vertically in L shape, and they are similar as the pair of groove walls 14 in the joint base 30. The slit 83 is drilled considering a size of opening and a position so that the joining plate 20 can be fitted into the slit 83 when the cover spacer 80 is covering the joint base 30.

Explaining about a state that this metal fitting 100 is assembled as joint metal, by using FIGS. 1 to 4. At first, the bolt holes 18, 19 are drilled at the plane section 10 of the joint base 30 of this metal fitting 100. The fastening bolts 160 are positioned in the horizontal member 200 to be penetrated or embedded in width direction Y of the horizontal member, such that the fastening bolts 160 penetrate through the bolt holes 18, 19. The joint base 30 is placed on the horizontal member 200 such that the fastening bolts 160 penetrate through the bolt holes 18, 19, and fixed by fastening the bolts.

Next, an opening of the joint base 30 is covered by the cover spacer 80. At this time, the joining plate 20 is penetrated through the slit 83 drilled at the plane section 81 of the cover spacer 80. And, tips 161 of the fastening bolts 160 and the nuts 60 screwed to the fastening bolts 160 are housed in box-shaped space 84 surrounded by the joint base 30 and the cover spacer 80.

Figure 7:
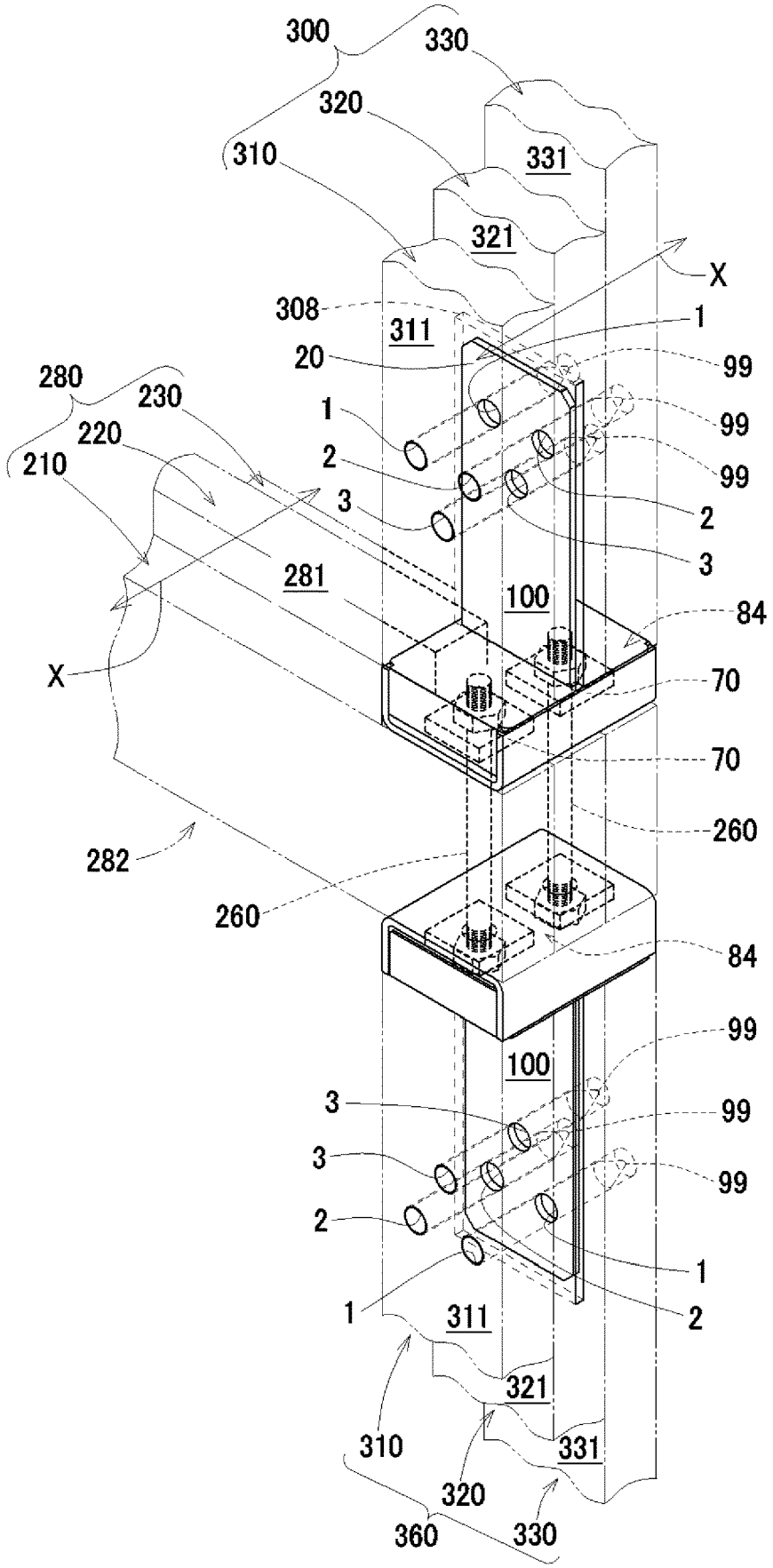
FIG. 7 is a perspective view illustrating a state that pillars are joined to both upper and lower surfaces of a horizontal member interposed between upper and lower floors by using the metal fittings of FIG. 1.

In addition, as illustrated in FIGS. 1, 2 and 7, in a state that the cover spacer 80 is covering the joint base 30, little gap is provided between the groove walls 82 of the cover spacer 80 and the plane section 10. It is configured that inside of the box-shaped space 84 can be seen from this gap. Therefore, it is possible to visually confirm the tips 161 of the fastening bolts 160 and the nuts 60 screwed to the fastening bolts 160 housed in the box-shaped space 84. As a result, when there is a defect like unfastening of the nut 60 or the like, it can be handled easily by finding the defect by visual confirmation after construction.

As illustrated in FIGS. 3 and 5, in this metal fitting 100, two bolt holes 18, 19 are drilled in predetermined spacing along a center line K in its groove shape at the plane section 10 of the joint base 30. Inner diameter of these bolt holes 18, 19 are much larger than a contour of the fastening bolts 160 penetrated through these bolt holes 18, 19. In other words, large play is provided for inner diameter of the bolt holes 18, 19.

Therefore, as a countermeasure for little error which occurs during construction, it is possible to absorb considerable error by penetrating the bolts 160 at a shifted position deviated from a center of the bolt holes 18, 19. For example, inner diameter of the bolt holes 18, 19 may be larger than maximum outer diameter of the nuts 60, according to condition of washers 70 mentioned below, in order to secure higher misalignment accuracy by enlarging allowable limit for absorbing an error by inclination or displacement of the anchor bolts 160 embedded in the foundation concrete 150.

However, there is a risk that problem occurs to fixing strength when the bolts 160 are penetrated through the bolt holes 18, 19 at a shifted position displaced from a center until maximum allowable limit. In more detail, contact area of the nuts 60 with respect to peripheral surface of the bolt holes 18, 19 in the plane section 10 of the joint base 30 becomes unequal, so fixing strength depending on fixing friction will be decreased. As a result, there is a risk that a function of the pillar fixing metal fitting to fix the pillar 300 rigidly to the foundation or the horizontal member 200, while increasing earthquake-resistant and wind-resistant strength and misalignment accuracy, will be impaired.

Here, they are fastened by the nuts 60 via the washers 70. It is preferable that this washer 70 is rectangular parallelepiped with conditions that it is having a shape of maximum area capable of being housed in applied position with allowance, and that it is having a maximum thickness which does not hinder screwing, and that it is having (unillustrated) bolt hole with minimum diameter for letting the bolt 160 to penetrate through. Thereby, contact area of the nut 60 and the washer 70 becomes equal with respect to circumferential direction, so fixing strength depending on fixing friction can be maintained stably. However, it is not necessary to always limit to the above conditions of the washer 70, and appropriate washer may be selected from general circular washer, square washer, circular washer with spring washer, square washer with spring washer, and other washer, and used considering availability, burden for material component management, and cost.

In addition, a groove hole 308 capable of receiving the joint base 30 is drilled at the pillar 300 such that the groove hole 308 is cut from the end surface 301 of the pillar 300 to axial direction. On the other hand, the joining plate 20 capable of fitting into the groove hole 308 is arranged to stand at the joint base 30. And, the joining plate 20 of the joint base 30 is fitted into the groove hole 308 of the pillar 300, and also, the end surface 301 of the pillar 300 is abutted to the plane section 81 of the cover spacer 80, and the pillar 300 is arranged to stand at the horizontal member 200. Then, the pillar 300 and the joining plate 20 fitted into the groove hole 308 drilled at the pillar 300 are drift-pin joined by three drift pins 99.

As a result, the pillar 300 is fixed rigidly to the horizontal member 200 with this metal fitting 100 as the joint metal. In this way, according to the present invention, it is possible to provide the pillar fixing metal fitting 100 for rigidly joining the pillar 300 to the foundation or the horizontal member 200, while increasing earthquake-resistant and wind-resistant strength and misalignment accuracy, and also, optimizing not only for I.D.S construction method but also for 2×4 construction method by facilitating assembly by making joint fitting using joint by manual operation of skilled worker unnecessary, also in circumstance that it is difficult to secure the skilled workers.

In addition, according to this metal fitting 100, there are two following effects more excellent than conventional 2×4 construction method. At first, there is an effect that accuracy of the house will be improved. This is because the pillar 300 will be positioned to the horizontal member 200 by fitting the joining plate 20 of the joint base 30 into the groove hole 308 of the pillar 300. Also, secondly, there is an effect that it will be easy to renovate the house. This is because the pillar (vertical member) 300 can be replaced easily, as joint between the pillar (vertical member) 300 and the horizontal member 200 can be detached easily by removing drift pins 99 from the fitting holes 1 to 3 for the drift pins 99.

Figure 5A:
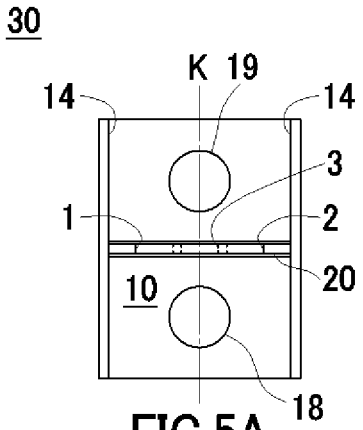
FIG. 5(A) is a plan view.
Figure 5B:
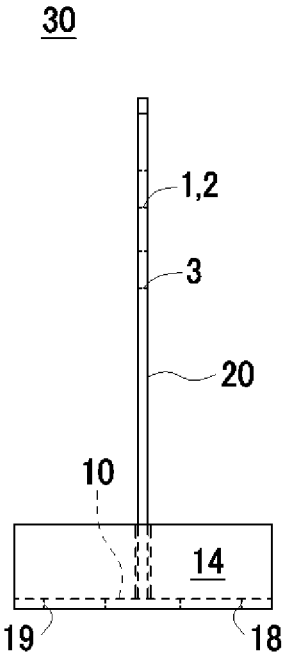
FIG. 5(B) is a left side view.
Figure 5C:
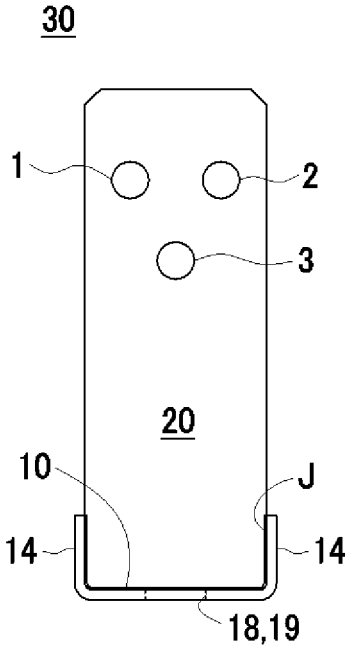
FIG. 5(C) is a front view.
Figure 5D:
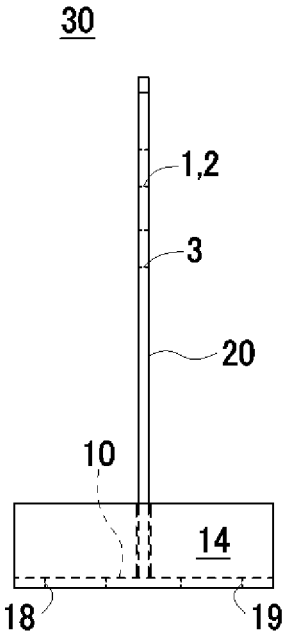
FIG. 5(D) is a right side view.
Figure 5E:
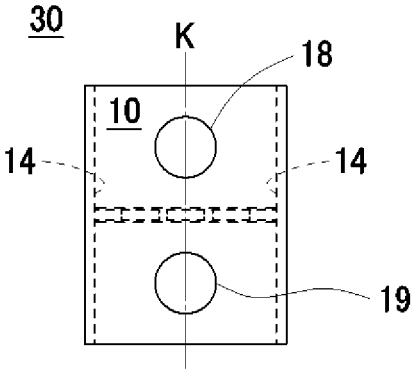
FIG. 5(E) is a bottom view, respectively.

Next, illustrating this metal fitting 100 in a method of projection for facilitating implementation of the present invention for those who skilled in the art. FIG. 5 is five surface drawings illustrating the joint base of FIG. 3 in a method of projection, and FIG. 5(A) is a plan view, FIG. 5(B) is a left side view, FIG. 5(C) is a front view, FIG. 5(D) is a right side view, and FIG. 5(E) is a bottom view, respectively.

Figure 6A:
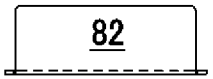
FIG. 6(A) is a back view.
Figure 6B:
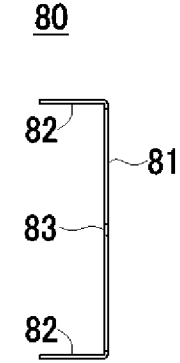
FIG. 6(B) is a left side view.
Figure 6C:
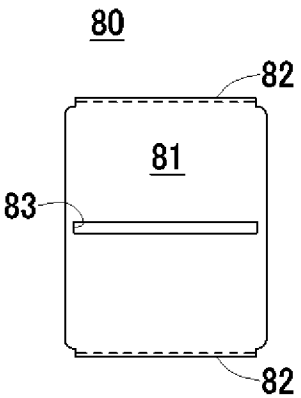
FIG. 6(C) is a plan view.
Figure 6D:
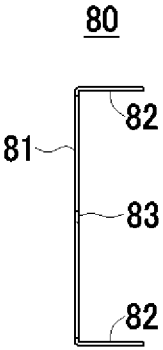
FIG. 6(D) is a right side view.
Figure 6E:
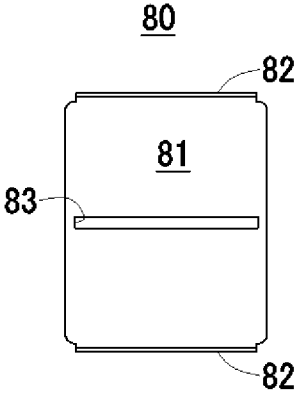
FIG. 6(E) is a bottom view.
Figure 6F:
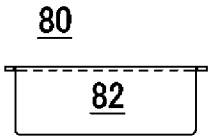
FIG. 6(F) is a front view, respectively.

FIG. 6 is six surface drawings illustrating the cover spacer of FIG. 4 in a method of projection, and FIG. 6(A) is a back view, FIG. 6(B) is a left side view, FIG. 6(C) is a plan view, FIG. 6(D) is a right side view, FIG. 6(E) is a bottom view, and FIG. 6(F) is a front view, respectively. In addition, a shape, a pattern or combination thereof of articles (including part of article) composing this metal fitting 100 illustrated in FIGS. 1 to 6 creates aesthetic impression visually.

Next, explaining that strength equal to or more than strength of through pillar can be obtained by this metal fitting 100. FIG. 7 is a perspective view illustrating a state that pillars are joined to both upper and lower surfaces of a horizontal member interposed between upper and lower floors by using the metal fittings of FIG. 1. As illustrated in FIG. 7, two sets of the metal fittings 100 are used and connected between an upper pillar 300 and a lower pillar 360 via a crosspiece 280. By this connecting figuration, it is possible to obtain strength equal to or more than strength when through pillar over upper and lower floors is used. The pillar fixing metal fittings 100 are configured such that the plane sections 10 of the joint bases 30 respectively arranged at upper and lower surfaces 281, 282 of the crosspiece 280, which is a horizontal member 200, are fastened by fastening bolts 260 penetrated through the crosspiece 280 and nuts 60 screwed to the fastening bolts 260, and also, each joining plate 20 of each joint base 30 is drift-pin joined to respective pillar 300 or 360.

The upper pillar 300 and the lower pillar 360 are not through pillar and joined via the crosspiece 280. In the conventional construction method, these joined parts have been indicated as worst weak point, as first cause for a house to collapse by earthquake, and even if it is a through pillar, it is a weak point to the extent that the through pillar will be broken by lateral vibration. Here, as illustrated in FIG. 7, through pillar is not used, and by using two sets of the metal fittings 100, the upper pillar 300 and the lower pillar 360 are connected via the crosspiece 280 in between the upper pillar 300 and the lower pillar 360. By this connecting figuration, it is possible to obtain strength equal to or more than strength of connecting figuration using through pillar over upper and lower floors.

The through pillar in conventional construction method will be weakened as material of the pillar is significantly cut out for a hole for joining in the joined part configured to insert the crosspiece 280 such as a beam laterally. On the other hand, according to connecting figuration using the metal fittings 100 as illustrated in FIG. 7, the upper pillar 300 and the lower pillar 360 are joined mutually and integrally by the drift pins 99 fitted into the fitting holes 1 to 3 of the joining plate 20 fitted into respective groove hole 308. As a result, the joined part totally moves (vibrates) similar to earthquake vibration with respect to external force, so it is possible to obtain connecting figuration of upper and lower pillars excellent in yield strength.

Second Embodiment

Figure 8:
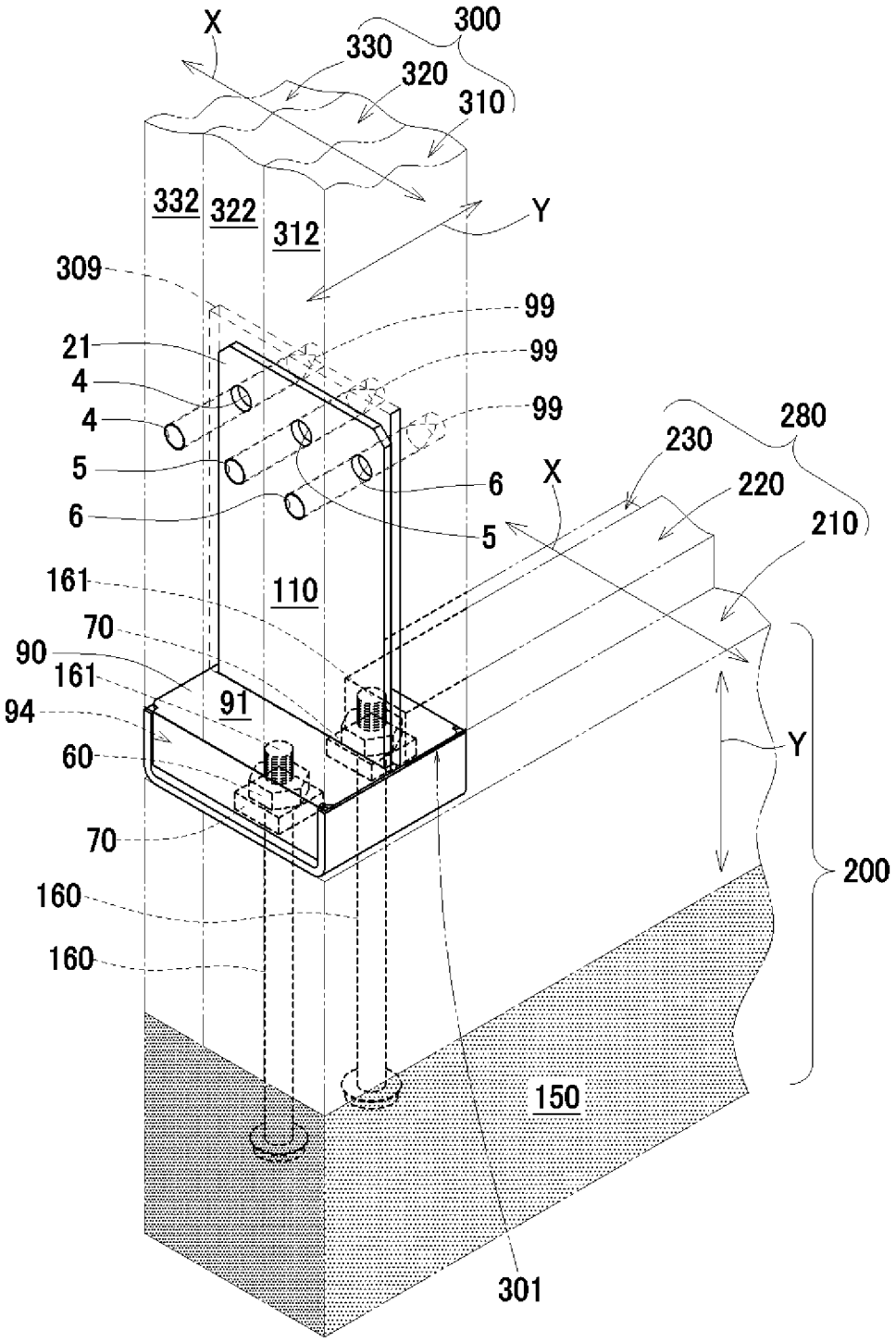
FIG. 8 is a perspective view illustrating used state of a pillar fixing metal fitting (hereinafter, also referred to as "this metal fitting") relating to second embodiment of the present invention.

Explaining about second embodiment of the present invention by referring to FIGS. 8 to 14. FIG. 8 is a perspective view illustrating used state of a pillar fixing metal fitting (this metal fitting) relating to second embodiment of the present invention. This metal fitting 110 of second embodiment illustrated in FIG. 8 is similar to this metal fitting 100 of first embodiment explained using FIGS. 1 to 7, so explanation about common configuration, function and effect is mostly omitted. In addition, main advantage common in both embodiments is a point that it is suitable not only for I.D.S construction method, but also for 2×4 construction method. Especially, both embodiments are optimized for joining the pillar 300 composed of three dimension lumbers 310, 320, 330 of 2×4 construction method superposed in thickness direction X and the crosspiece 280 composed of three dimension lumbers 210, 220, 230 of 2×4 construction method superposed in thickness direction X.

Difference between both embodiments is angular setting between superposing direction of the pillar 300 composed by superposing three dimension lumbers and the joining plate 20, 21. The superposing direction of the pillar 300 is thickness direction X of the dimension lumbers 310, 320, 330. About angular setting of the joining plate 20, 21 with respect to the superposing direction of the pillar 300, the joining plate 20 of this metal fitting 100 of first embodiment illustrated in FIG. 1 is being orthogonal to the thickness direction X, but the joining plate 21 of this metal fitting 110 of second embodiment illustrated in FIG. 8 is being parallel to the thickness direction X. In other words, the joining plate 20 of this metal fitting 100 of first embodiment illustrated in FIG. 1 is being parallel to wide surfaces 311, 321, 331 of the dimension lumbers 310, 320, 330, but the joining plate 21 of this metal fitting 110 of second embodiment illustrated in FIG. 8 is being orthogonal to wide surfaces of the dimension lumbers 310, 320, 330.

In addition, the groove hole 308, 309 for fitting in the joining plate 20, 21 is previously drilled in axial direction from the end surface 301 (FIG. 8) of the pillar 300. Also, regarding to these groove holes 308, 309, the groove hole 308 of first embodiment illustrated in FIG. 1 is being orthogonal to the thickness direction X of the dimension lumbers 310, 320, 330, but being parallel to the wide surface 311, 321, 331. On the other hand, the groove hole 309 of second embodiment illustrated in FIG. 8 is being parallel to the thickness direction X of the dimension lumbers 310, 320, 330, but being orthogonal to the wide surface.

The groove hole 308 of first embodiment illustrated in FIG. 1 is only drilled at one dimension lumber 320 positioned at intermediate layer among three superposed dimension lumbers 310, 320, 330. This groove hole 308 is drilled at center position of thickness of the dimension lumber 320 parallel to the wide surface 321 of the dimension lumber 320. Therefore, the joining plate 20 fitted into the groove hole 308 directly contacts only with one dimension lumber 320. In addition, in the pillar 300, the dimension lumber 320 of intermediate layer is held between the dimension lumbers 310, 330 of both side layers such that the wide surfaces 311, 321, 331 are adhered to each other. As a result, three layers of dimension lumbers 310, 320, 330 are integrated with the joining plate 20 as a center via the drift pins 99 fitted into the fitting holes 1 to 3 penetrating the dimension lumbers 310, 320, 330 entirely in thickness direction X, and also, the dimension lumbers 310, 320, 330 are joined integrally to the horizontal member 200.

On the other hand, the groove hole 309 of second embodiment illustrated in FIG. 8 is drilled over all three layers of dimension lumber 310, 320, 330 at center position of width direction Y of the dimension lumbers 310, 320, 330. Therefore, the joining plate 21 fitted into the groove hole 309 directly contacts over all three layers of dimension lumbers 310, 320, 330. And, three layers of dimension lumbers 310, 320, 330 are joined such that three layers of dimension lumbers 310, 320, 330 continuously straddle the joining plate 21 at center position of the width direction Y respectively. In addition, fitting holes 4 to 6 are drilled at each layer at equal distance from the plane section 11, at approximate center position of thickness direction X in each thickness surface 312, 322, 332 of three layers of dimension lumbers 310, 320, 330.

These fitting holes 4 to 6 are penetrated through each layer while intervening the joining plate 21. Therefore, each of three layers of dimension lumbers 310, 320, 330 can obtain rigid joining strength with respect to the joining plate 21 independently via the drift pins 99 respectively fitted into the fitting holes 4 to 6. In addition, three layers of dimension lumbers 310, 320, 330 are integrated via the joining plate 21, and also, the dimension lumbers 310, 320, 330 are joined integrally to the horizontal member 200. As a result, an effect that it will be strong also for a stress in a direction to separate or detach three layers of dimension lumbers 310, 320, 330. Therefore, this metal fitting 110 is suitable for 2×4 construction method.

Figure 9:
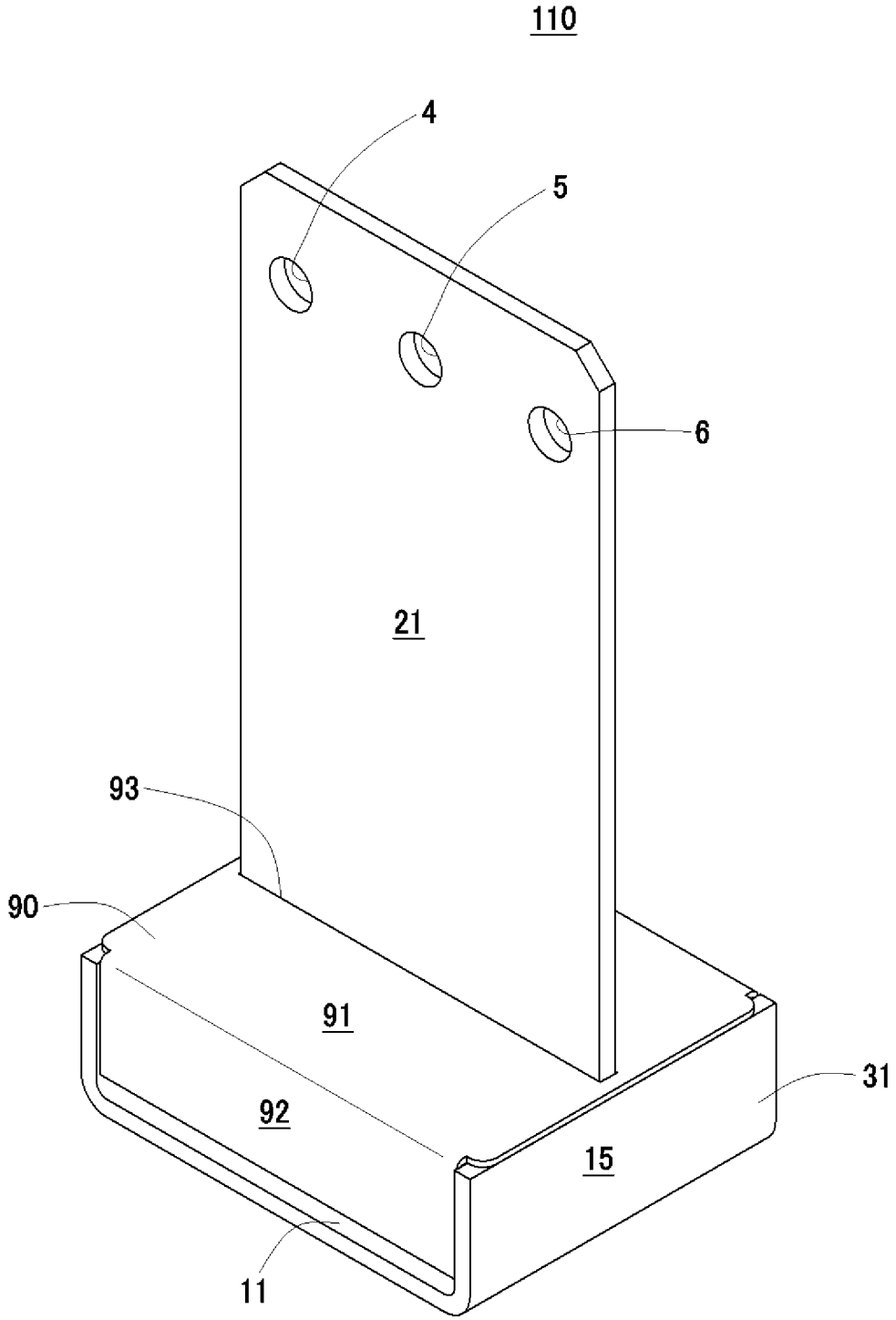
FIG. 9 is a perspective view illustrating entirety of this metal fitting by extracting this metal fitting from FIG. 8.
Figure 10:
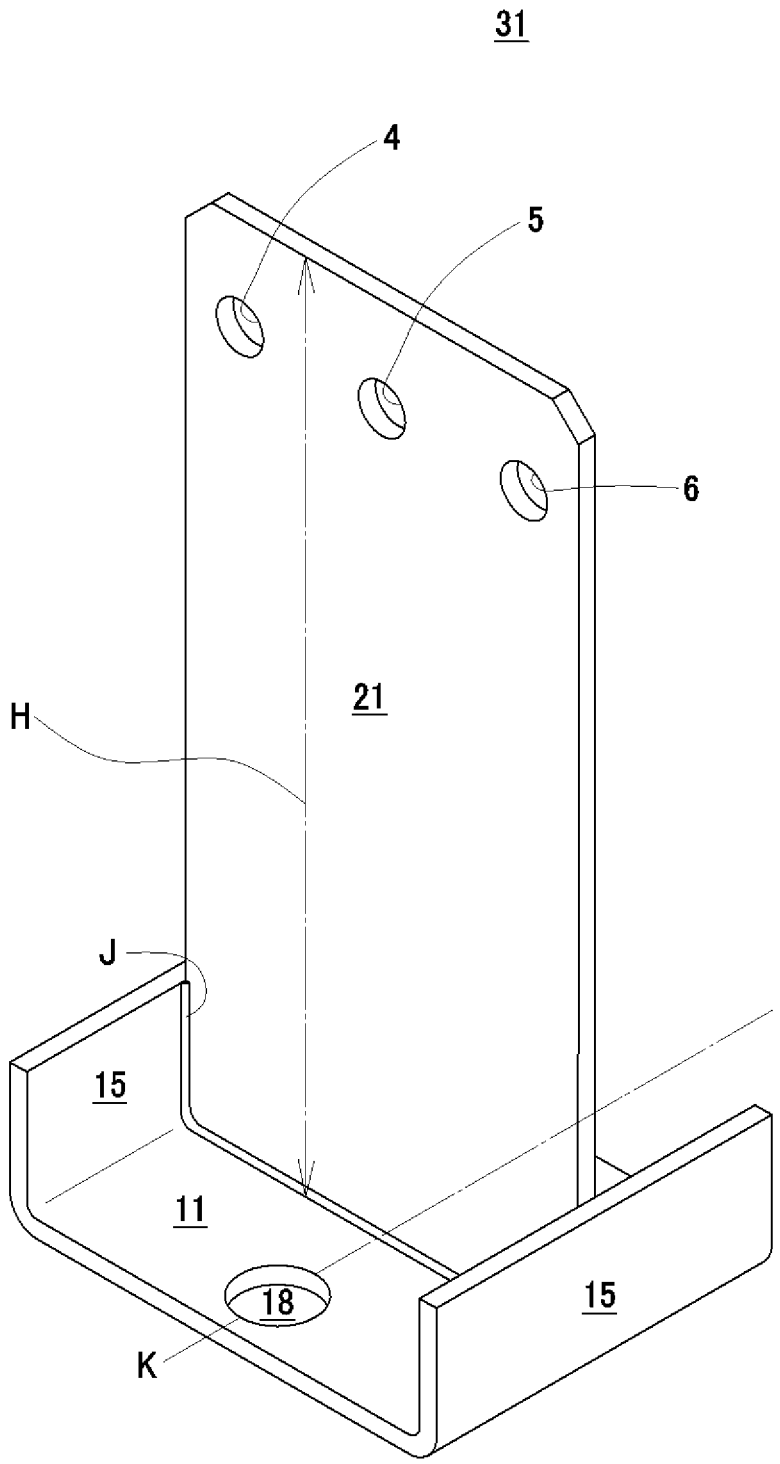
FIG. 10 is a perspective view illustrating a joint base mainly composing this metal fitting illustrated in FIGS. 8 and 9.
Figure 11:
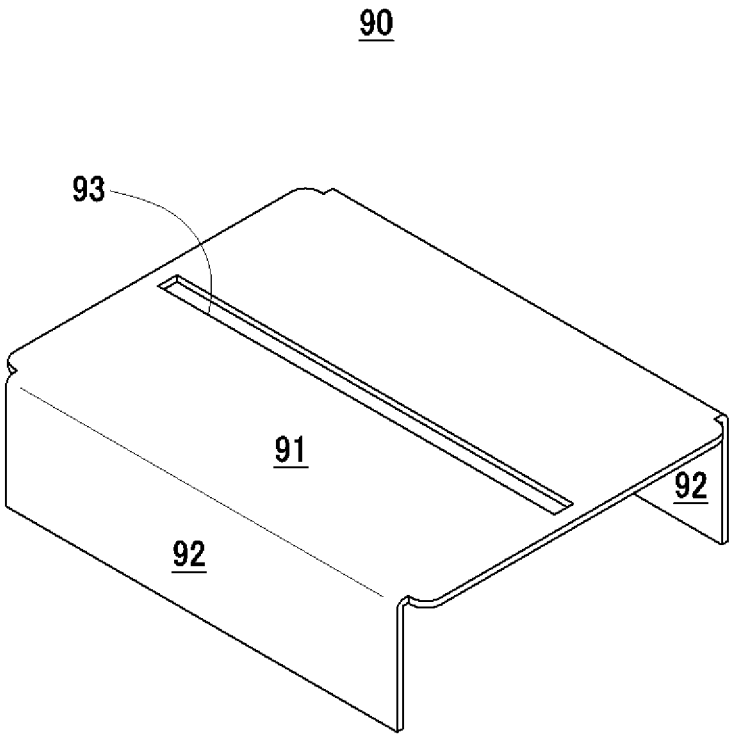
FIG. 11 is a perspective view illustrating a cover spacer in groove shape for covering the joint base illustrated in FIG. 10.

FIG. 9 is a perspective view illustrating entirety of this metal fitting 110 by extracting this metal fitting 110 from FIG. 8. FIG. 10 is a perspective view illustrating a joint base 31 mainly composing this metal fitting 110 illustrated in FIGS. 8 and 9. FIG. 11 is a perspective view illustrating a cover spacer 90 in groove shape for covering the joint base 31 illustrated in FIG. 10. This metal fitting 110 illustrated in FIGS. 8 to 11 is used as joint metal by combining the cover spacer 90 and the joint base 31 such that the cover spacer 90 covers an open surface of the joint base 31 in groove shape when constructing wooden building.

Figure 12A:
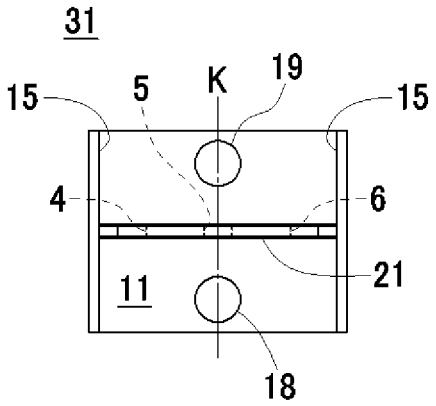
FIG. 12(A) is a plan view.
Figure 12B:
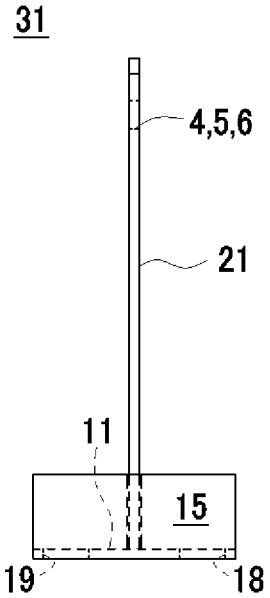
FIG. 12(B) is a left side view.
Figure 12C:
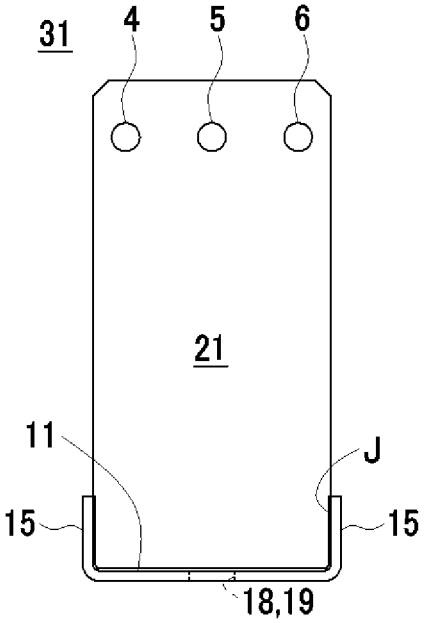
FIG. 12(C) is a front view.
Figure 12D:
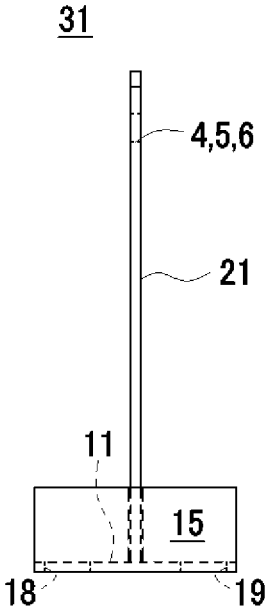
FIG. 12(D) is a right side view.
Figure 12E:
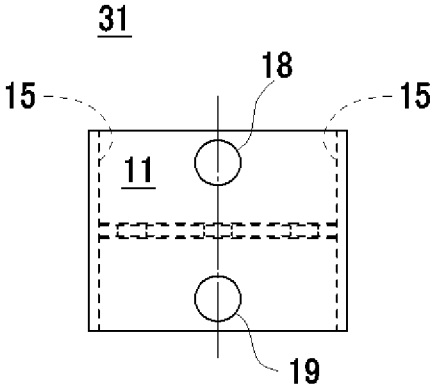
FIG. 12(E) is a bottom view, respectively.

In addition, illustrating this metal fitting 110 in a method of projection for facilitating implementation of the present invention for those who skilled in the art. FIG. 12 is five surface drawings illustrating the joint base 31 of FIG. 10 in a method of projection, and FIG. 12(A) is a plan view, FIG. 12(B) is a left side view, FIG. 12(C) is a front view, FIG. 12(D) is a right side view, and FIG. 12(E) is a bottom view, respectively.

Figure 13A:
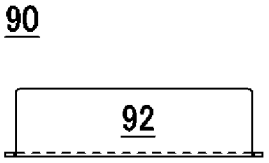
FIG. 13(A) is a back view.
Figure 13B:
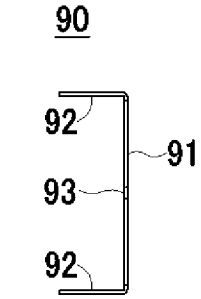
FIG. 13(B) is a left side view.
Figure 13C:
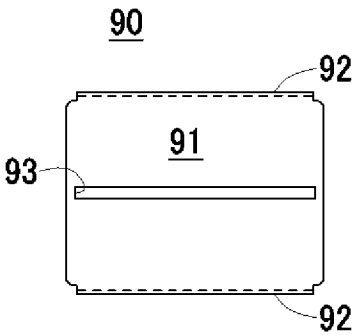
FIG. 13(C) is a plan view.
Figure 13D:
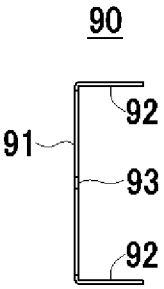
FIG. 13(D) is a right side view.
Figure 13E:
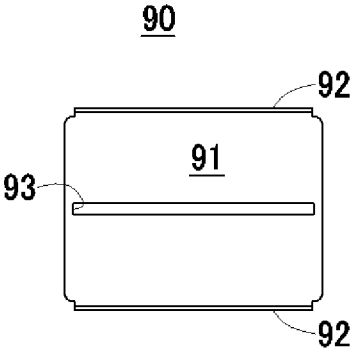
FIG. 13(E) is a bottom view.
Figure 13F:
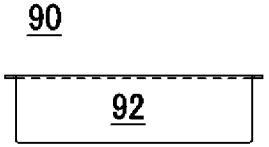
FIG. 13(F) is a front view, respectively.

FIG. 13 is six surface drawings illustrating the cover spacer 90 of FIG. 11 in a method of projection, and FIG. 13(A) is a back view, FIG. 13(B) is a left side view, FIG. 13(C) is a plan view, FIG. 13(D) is a right side view, FIG. 13(E) is a bottom view, and FIG. 13(F) is a front view, respectively. In addition, a shape, a pattern or combination thereof of articles (including part of article) composing this metal fitting 110 illustrated in FIGS. 8 to 13 creates aesthetic impression visually.

As illustrated in FIGS. 9 to 13, the cover spacer 90 is configured to comprise a plane section 91, a pair of groove walls 92, and a slit 93. The plane section 91 is in rectangular shape for supporting the pillar 300 by abutting to the end surface 301 (FIG. 8) of the pillar 300, and about the size of the plane section 91, it is similar as a plane section 11 of the joint base 31 (FIGS. 9 and 10). The pair of groove walls 92 is formed by respectively bending edges of the plane section 91 vertically in L shape, and they are similar as a pair of groove walls 15 in the joint base 31. The slit 93 is drilled considering a size of opening and a position so that the joining plate 21 can be fitted into the slit 93 when the cover spacer 90 is covering the joint base 31.

The pillar fixing metal fitting 110 is a joint metal for joining the pillar 300 and the horizontal member 200, and it is configured to use by combining the joint base 31 in groove shape and the cover spacer 90 in groove shape. The joint base 31 mainly composes the joint metal. The cover spacer 90 covers an open surface of the joint base 31 and formed with strength capable of supporting axial load of the pillar 300.

The joint base 31 (FIG. 10) is configured to comprise a plane section 11 in rectangular shape, a pair of groove walls 15, and a joining plate 21. The plane section 11 in rectangular shape coincides with a shape of the end surface 301 (FIG. 8) of the pillar 300, and two bolt holes 18, 19 are drilled in predetermined spacing on a center line K in groove shape of the plane section 11, and the plane section 11 is fastened to the horizontal member 200 in a state abutted to the horizontal member 200. The pair of groove walls 15 are formed by respectively bending edges parallel to the center line K vertically with respect to the plane section 11 in L shape. The joining plate 21 is configured to be supported at three sides continuously or discontinuously at welded part J contacting the pair of groove walls 15 and the groove bottom respectively. In addition, configuration to be supported at three sides at the welded part J is only an example, and it may be supported at two sides or one side. This joining plate 21 is arranged to stand between two bolt holes 18, 19 in the plane section 11 at a height H surpassing the groove walls 15.

The cover spacer 90 is configured to comprise a plane section 91 in rectangular shape, a pair of groove walls 92, and a slit 93. The slit 93 is drilled such that the joining plate 21 can be fitted into the slit 93 when the cover spacer 90 is covering the joint base 31. The plane section 91 in rectangular shape is configured to support the pillar 300 by abutting to the end surface 301 (FIG. 8) of the pillar 300. The pair of groove walls 92 are formed by respectively bending edges of the plane section 91 vertically in L shape.

In a state assembled as joint metal, the joint base 31 (FIG. 10) is fastened to the horizontal member 200 by bolt, and the end surface 301 (FIG. 8) of the pillar 300 is abutted on the cover spacer 90 covering the joint base 31, and the joining plate 21 standing from the joint base 31 and the pillar 300 are fixed by drift-pin joint with three drift pins 99. More precisely, it is as follows.

At first, the fastening bolts 260, 160 penetrating or embedded to the horizontal member 200 penetrates through the bolt holes 18, 19, and the plane section 11 of the joint base 31 is fastened to the horizontal member 200 by the nuts 60. The cover spacer 90 covers an open surface of the joint base 31. At this time, the joining plate 21 is penetrated into the slit 93, and also, tips 161 of the fastening bolts 260, 160 and the nuts 60 screwed to the fastening bolts 260, 160 are housed in box-shaped space 94 surrounded by the joint base 31 and the cover spacer 90.

Further, the pillar 300 is arranged to stand on the cover spacer 90 covering the joint base 31 such that the end surface 301 (FIG. 8) of the pillar 300 is abutted on the cover spacer 90. More precisely, the groove hole 309 is drilled to cut into axial direction from the end surface 301 of the pillar 300. On the other hand, the joining plate 21 is arranged to stand on the joint base 31 (FIGS. 9 and 10). And, the joining plate 21 of the joint base 31 is fitted into the groove hole 309 of the pillar 300, and also, the end surface 301 of the pillar 300 is abutted to the plane section 91 of the cover spacer 90, so the pillar 300 will be arranged to stand on the horizontal member 200. Then, the pillar 300 and the joining plate 21 fitted into the groove hole 309 drilled at the pillar 300 are drift-pin joined by three drift pins 99.

Next, explaining about difference of both embodiments by comparing FIGS. 1 and 8 illustrating respective perspective view of used state of both embodiments. As illustrated in FIG. 1, in this metal fitting 100 relating to first embodiment, the fitting holes 1 to 3 for the drift pins 99 are set to a hole size and a position relation such that the fitting holes 1 to 3 are drilled at each vertex of triangle drawable on plate surface of the joining plate 20, and penetrating through wide surfaces 311, 321, 331 of the dimension lumbers 310, 320, 330 in thickness direction X, and also, penetrating through the joining plate 20 vertically. In other words, in this metal fitting 100 relating to the first embodiment, about arrangement of three fitting holes 1 to 3, by arranging three fitting holes 1 to 3 at each vertex of regular triangle in one plate surface, a strength is maintained even if three fitting holes 1 to 3 are drilled close to each other. In addition, about the above regular triangle, it is only an example and it should not be limited to the regular triangle, and it may be other general triangles.

On the other hand, as illustrated in FIG. 8, in this metal fitting 110 relating to second embodiment, the fitting holes 4 to 6 for the drift pins 99 are set to a hole size and a position relation such that the fitting holes 4 to 6 are drilled at equal intervals on a straight line parallel to the plane section 11 on plate surface of the joining plate 21, and penetrating through thickness surfaces 312, 322, 332 of the dimension lumbers 310, 320, 330 respectively in width direction Y, and also, penetrating through the joining plate 21 vertically. In other words, in this metal fitting 110 relating to second embodiment, even if three fitting holes 4 to 6 are arranged in straight line close to each other, only one fitting hole 4 to 6 is drilled at one dimension lumber 310, 320, 330 and there is no continuity, so it will not be a cause for inducing breakage such as perforations of stamp.

Therefore, in this metal fitting 110 relating to second embodiment, it is possible to freely select an arrangement excellent in drilling activity with respect to both plate surface of the joining plate 21 and respective thickness surface 312, 322, 332 of the dimension lumbers 310, 320, 330. Therefore, the fitting holes 4 to 6 for the drift pins 99 are drilled at equal intervals on a straight line parallel to the plane section 11 on plate surface of the joining plate 21. In addition, correspondingly, the fitting holes 4 to 6 are drilled at equal distance from the plane section 11, at approximate center position of thickness direction X in each thickness surface 312, 322, 332 of dimension lumbers 310, 320, 330. In addition, arrangement for drilling the fitting holes 4 to 6 may not be always in straight line parallel to the plane section 11 on plate surface of the joining plate 21.

Figure 14:
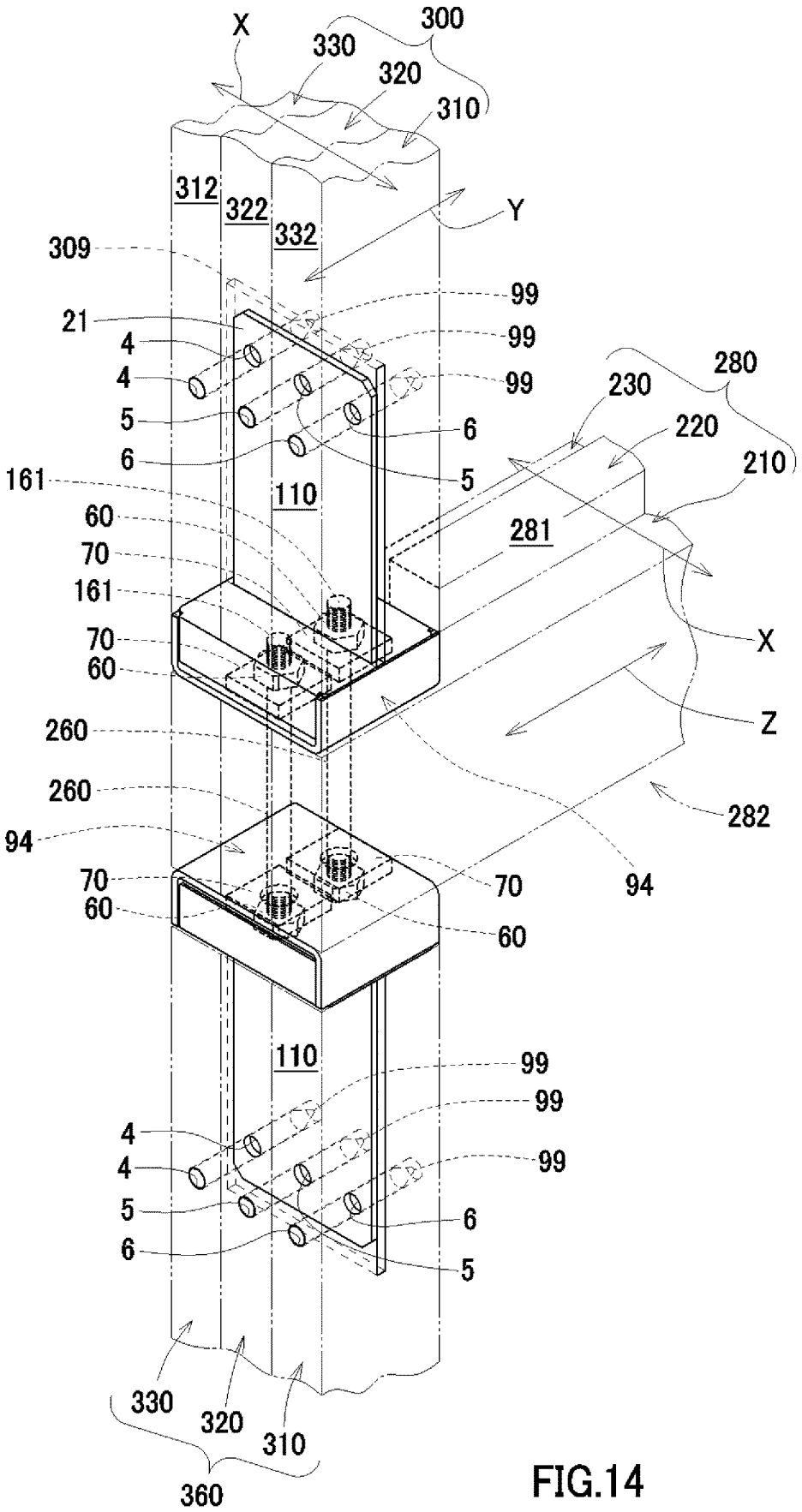
FIG. 14 is a perspective view illustrating a state that pillars are joined to both upper and lower surfaces of a horizontal member interposed between upper and lower floors by using the metal fittings of FIG. 8.

Next, by this metal fitting 110, explaining that strength equal to or more than strength of through pillar can be obtained. FIG. 14 is a perspective view illustrating a state that pillars are joined to both upper and lower surfaces of a horizontal member interposed between upper and lower floors by using the metal fittings of FIG. 8. As illustrated in FIG. 14, two sets of the metal fittings 110 are used and connected via the crosspiece 280 between the upper pillar 300 and the lower pillar 360. By this connecting figuration, it is possible to obtain strength equal to or more than strength when through pillar over upper and lower floors is used. The pillar fixing metal fittings 110 are configured such that the plane sections 11 of the joint bases 31 respectively arranged at both upper and lower surfaces 281, 282 of the crosspiece 280, which is a horizontal member 200, are fastened by fastening bolts 260 penetrated through the crosspiece 280 and nuts 60 screwed to the fastening bolts 260, and also, each joining plate 21 of each joint base 31 is drift-pin joined to respective pillar 300 or 360.

About an effect that it is possible to obtain strength equal to or more than strength of connecting figuration using through pillar over upper and lower floors by the connecting figuration illustrated in FIG. 14, it is same as this metal fitting 100 relating to first embodiment explained using FIG. 7. As a result, the joined part totally moves (vibrates) similar to earthquake vibration with respect to external force, so it is possible to obtain connecting figuration of upper and lower pillars excellent in yield strength. This effect is also same as this metal fitting 100 relating to first embodiment.

As explained in the above, this metal fitting 110 relating to second embodiment can be assembled easily and can increase earthquake-resistant and wind-resistant strength and misalignment accuracy, and also, can be optimized not only for I.D.S construction method but also for 2×4 construction method by making joint fitting using joint by manual operation of skilled worker unnecessary, as well as this metal fitting 100 relating to first embodiment.

The pillar fixing metal fitting relating to the present invention can be adopted as joint metal for joining the pillar to the horizontal member in wooden building in a circumstance that it is difficult to secure the skilled workers who can perform high quality joint working efficiently, or in an area there is no wood working plant or equivalent facility for performing precise joint working. Especially, it is suitable to be adopted for 2×4 construction method and I.D.S construction method.

GLOSSARY OF DRAWING REFERENCES

1 to 6 Fitting holes (for drift pins 99)
10, 11 Plane section (of joint base 30, 31)
14, 15, 82, 92 Groove walls
18, 19 Bolt holes (of plane section 10)
20, 21 Joining plate (of joint base 30, 31)
30, 31 Joint base
60 Nut
70 Washer
80, 90 Cover spacer
81, 91 Plane section (of cover spacer 80, 90)
83, 93 Slit
84, 94 Box-shaped space
99 Drift pin
100, 110 Pillar fixing metal fitting
150 Foundation concrete
160 Fastening bolt or anchor bolt (embedded in foundation concrete 150)
161 Tip (of fastening bolt 160, 260)
180 Foundation (horizontal part)
200 Horizontal member (horizontal part)
210, 220, 230 Dimension lumbers (of 2×4 construction method forming crosspiece 280)
260 Fastening bolt (penetrating through crosspiece 280)
280 Crosspiece (horizontal part)
281, 282 Upper and lower surfaces (of crosspiece 280)
300, 360 Pillar
301 End surface (of pillar 300)
310, 320, 330 Dimension lumbers (of 2×4 construction method forming pillar 300)
308, 309 Groove hole (drilled at pillar 300)
311, 321, 331 Wide surface (of dimension lumbers 310, 320, 330)
312, 322, 332 Thickness surface (of dimension lumbers 310, 320, 330)
H Height (of joining plate 20)
J Welded Part
K Center line
X Thickness direction
Y Width direction (of respective dimension lumber 310, 320, 330 forming pillar 300)

The invention claimed is:

1. A pillar fixing metal fitting for joining a pillar to a horizontal part, comprising:
- a joint base in groove shape mainly composing a joint metal;
- a cover spacer in groove shape capable of supporting axial load of the pillar by covering an open surface of the joint base,
- wherein the joint base comprising:
  - a plane section in rectangular shape comprising bolt holes and a shape of which coincides with an end surface of the pillar;
  - a pair of groove walls composed of side edges on only two opposing sides of four sides of the plane section respectively bent vertically in L shape; and
  - a joining plate standing at a height surpassing the pair of groove walls from the plane section and supported by a welded part contacting at least the pair of groove walls or a groove bottom,
- wherein the cover spacer comprising:
  - a plane section in rectangular shape for supporting the pillar by abutting to the end surface of the pillar;
  - a pair of groove walls that are placed on and perpendicular to the pair of groove walls of the joint base and that is composed of side edges on only two opposing sides of four sides of the plane section respectively bent vertically in L shape; and
  - a slit drilled such that the joining plate will be fitted into the slit when the cover spacer is covering the joint base,
- wherein when the joint metal is installed, a plurality of fastening bolts are penetrated through or embedded in a horizontal member composing the horizontal part are penetrated through the bolt holes, and the plane section of the joint base is fastened to the horizontal member by nuts,
- further, the joining plate is penetrated through the slit, and also, tips of the fastening bolts and the nuts screwed to the fastening bolts are housed in a box-shaped space surrounded by the joint base and the cover spacer,
- the end surface of the pillar abuts the plane section of the cover spacer, and also, the pillar and the joining plate fitted into a groove hole drilled at the pillar are drift-pin joined by a plurality of drift pins.

2. The pillar fixing metal fitting according to claim 1, wherein the pillar is composed of dimension lumbers of wooden wall frame construction method (2×4 construction method) superposed plurally in a thickness direction.

3. The pillar fixing metal fitting according to claim 2, wherein fitting holes for the drift pins are drilled at each vertex of triangle drawable on a plate surface of the joining plate, and penetrating through wide surfaces of the dimension lumbers and the joining plate vertically.

4. The pillar fixing metal fitting according to claim 3, wherein the horizontal member is composed of a foundation concrete or a foundation mounted on the foundation concrete, and the fastening bolts are composed of anchor bolts embedded in the foundation concrete.

5. The pillar fixing metal fitting according to claim 3, wherein the plane section of the joint base arranged respectively on both upper and lower surfaces of a crosspiece, which is the horizontal member, is fastened by the fastening bolts penetrating through the crosspiece and the nuts screwed to the fastening bolts, and also, each of the joining plates of each of the joint base is drift-pin joined to respective pillar.

6. The pillar fixing metal fitting according to claim 2, wherein fitting holes for the drift pins are drilled at equal intervals on a straight line parallel to the plane section on a plate surface of the joining plate, and penetrating through thickness surfaces of the dimension lumbers and the joining plate vertically.

7. The pillar fixing metal fitting according to claim 6, wherein the horizontal member is composed of a foundation concrete or a foundation mounted on the foundation concrete, and the fastening bolts are composed of anchor bolts embedded in the foundation concrete.

8. The pillar fixing metal fitting according to claim 6, wherein the plane section of the joint base arranged respectively on both upper and lower surfaces of a crosspiece, which is the horizontal member, is fastened by the fastening bolts penetrating through the crosspiece and the nuts screwed to the fastening bolts, and also, each of the joining plates of each of the joint base is drift-pin joined to respective pillar.

9. The pillar fixing metal fitting according to claim 2, wherein the horizontal member is composed of a foundation concrete or a foundation mounted on the foundation concrete, and the fastening bolts are composed of anchor bolts embedded in the foundation concrete.

10. The pillar fixing metal fitting according to claim 2, wherein the plane section of the joint base arranged respectively on both upper and lower surfaces of a crosspiece, which is the horizontal member, is fastened by the fastening bolts penetrating through the crosspiece and the nuts screwed to the fastening bolts, and also, each of the joining plates of each of the joint base is drift-pin joined to respective pillar.

11. The pillar fixing metal fitting according to claim 1, wherein the horizontal member is composed of a foundation concrete or a foundation mounted on the foundation concrete, and the fastening bolts are composed of anchor bolts embedded in the foundation concrete.

12. The pillar fixing metal fitting according to claim 1, wherein the plane section of the joint base arranged respectively on both upper and lower surfaces of a crosspiece, which is the horizontal member, is fastened by the fastening bolts penetrating through the crosspiece and the nuts screwed to the fastening bolts, and also, each of the joining plates of each of the joint base is drift-pin joined to a respective pillar.

13. The pillar fixing metal fitting according to claim 1, wherein a gap is provided between the pair of groove walls of the cover spacer and the plane section of the joint base.

* * * * *